United States Patent [19]

Merklinger et al.

[11] Patent Number: 4,671,012

[45] Date of Patent: Jun. 9, 1987

[54] SECURITY BARRIER

[76] Inventors: William E. Merklinger, R.R. #1, Uxbridge, Ontario, Canada, L0C 1K0; Daniel Webster, 1637 Wavell Crescent, Mississauga, Ontario, Canada, L4X 1X2; Raymond Kampus, 155 Gordon Baker Drive, Suite 111, Willowdale, Ontario, Canada, M2H 3N7

[21] Appl. No.: 744,719

[22] Filed: Jun. 14, 1985

[30] Foreign Application Priority Data

Jun. 19, 1984 [CA] Canada ..... 456957

[51] Int. Cl.[4] ..... E06B 3/68

[52] U.S. Cl. ..... 49/55; 49/57

[58] Field of Search ..... 49/50, 55, 56, 57; 160/225

[56] References Cited

U.S. PATENT DOCUMENTS

| | | | |
|---|---|---|---|
| 999,682 | 8/1911 | Suits . | |
| 2,722,722 | 11/1955 | Mussman | 49/57 |
| 2,794,217 | 6/1957 | Croft | 49/57 X |
| 3,738,062 | 6/1973 | Ughi . | |
| 4,038,800 | 8/1977 | Daley . | |
| 4,358,910 | 11/1982 | Keating et al. . | |
| 4,394,805 | 7/1982 | Napper | 49/55 |
| 4,437,265 | 3/1984 | Turro et al. . | |

FOREIGN PATENT DOCUMENTS

| | | |
|---|---|---|
| 287463 | 2/1929 | Canada . |
| 471248 | 2/1951 | Canada . |
| 575959 | 12/1955 | Canada . |
| 1144428 | 4/1983 | Canada . |

*Primary Examiner*—Kenneth Downey
*Attorney, Agent, or Firm*—Nixon & Vanderhye

[57] ABSTRACT

A guard device adapted to bar an opening, such as a window or door of a house, is disclosed comprising in combination a number of bars being adapted to lie across the opening, an inner casing being adapted to secure the bars, an outer casing being adapted to be attached by a fastener about the opening and being adapted to receive the inner casing to cover the fastener, a connector being adapted to releasably connect the inner casing to the outer casing, and a lock adapted to lock and unlock the connector.

6 Claims, 4 Drawing Figures

SECURITY BARRIER

This invention relates to a barrier for a window or door or the like, particularly to a framework of bars which is adapted to be fitted to a window or a doorway to prevent the entrance of unauthorized persons.

The prior art relating to window guards includes the Canadian Letters Pat. No. 1,144,428 entitled "Telescopic Window Guard" which issued to E. Kutney, Apr. 12, 1983. This patent describes a window guard device which telescopes to be adjustable to fit a variety of window sizes. The window guard comprises a plurality of longitudinally extending, parallel spaced apart bars connected between a first frame member and a first end plate, on the one hand, and a second frame member and a second end plate on the other hand, each such end plate permanently connecting the ends of one set of bars while permitting the other set of bars to slide within it, thereby providing telescopic movement and overcoming the deficiency of certain prior art telescoping window guard devices as discussed in said patent. In particular overcoming the deficiency of the Hawkins U.S. Pat. No. 471,248 wherein the window bars were attached a frame member by set screws which might be removed by a burglar.

Canadian Letters Pat. No. 290,226 entitled "Window Grating" which issued to O. M. Rexinger Feb. 26, 1929 describes a spring-loaded telescoping bar type of window guard adapted to be affixed in the frame of a window.

It is an object of the present invention to provide a guard device which is an improvement over similar devices disclosed in the prior art, wherein the frame of the guard device is adjustable to permit it to be inserted not only in openings having square side members but also openings having side members which are disposed at an angle to the plane of the opening.

It is an object of this invention to provide a window guard device which may be locked or unlocked for removal or installation on openings having square or angled sides.

It is an object of this invention to provide a guard device having a construction which permits ease of manufacture, reduced costs, while providing superior strength to many of those guard devices disclosed in the prior art.

It is an object of this invention to provide a barrier for doors and windows and the like which may be installed and removed from time to time in a simple manner. It will be appreciated that this object is important because a security barrier can trap people during a fire or other emergency when the usual exits are unaccessible. Moreover, this feature of removeability allows certain openings, such as a rear entrance of a house, to be barred against intruders if the occupants are away for an extended period, for example, on vacation. It is recognized that Kutney provides for a hinged barrier with a lock but the present construction is more versatile and is an improvement on Kutney.

The present invention which is directed to these objects is a guard device adapted to bar an opening, such as a window or door of a house, which comprises in combination;

a plurality of bars being adapted to lie across said opening, an inner casing being adapted to secure said bars, an outer casing being adapted to be attached by fastening means about said opening and being adapted to receive said inner casing to cover said fastening means, a connecting means being adapted to releaseably connect said inner casing to said outer casing, a locking means being adapted to lock and unlock said connecting means.

It is also useful that the window barrier of this invention have the ability to be readily adjusted to fit a variety of sizes of openings. Therefore an embodiment of this invention has been developed with telescoping rods and tubes which permits such adjustement in at least one direction. The construction of this embodiment is different from that of Kutney in C.P. No. 1,144,428 in that the rods telescope within the tubes more in the manner shown by Rexinger in CP No. 287,463. However, the present construction, while in some respects similar to each of these prior art designs is different from both and is believed to be an improvement thereon. In particular it provides much greater strength than Rexinger against bending of the telescoping joint while employing fewer parts than Kutney thereby reducing costs and weight. Moreover, this constuction is better suited to low cost manufacturing methods as will become apparent from this disclosure.

The present invention in the telescoping embodiment comprises in combination;

parallel bars including a plurality of first and second rods and an equal plurality of first and second tubes, each said first rod being adapted to fit slideably within a corresponding first tube and each said second rod being adapted to fit slideably within a corresponding second tube, each said first rod and each said second tube having a first end being affixed in a spaced apart relationship longitudinally along a first inner casing, each said second rod and each said first tube having a first end affixed in a spaced apart relationship longitudinally along a second inner casing, each said first tube having a second end being adapted to protrude slideably through a first strapping plate and to protrude through and be affixed to a second strapping plate, each said second tube having a second end being adapted to protrude slideably through said second strapping plate and to protrude through and be affixed to said first strapping plate, first and second outer casings each being adapted to be attached to an opposing side of said opening, said first outer casing being adapted to be connected to said first inner casing to permit limited rotation of said outer casing about a longitudinal axis, said second outer casing being adapted to be connected to said second inner casing for limited rotation of said second outer casing about a longitudinal axis, wherein said guard device may be connected across said opening to bar entrance to intruders.

The outer casings may be connected to the inner casings by a locking device so that the inner casings and bars may be removed as a unit from the opening while the outer casings remain connected to the sides of the opening. Similarly the unit may be installed simply and locked into place.

In certain embodiments of this invention the outer casing and the inner casing connect to provide an enclosure which encases the elements connecting them and the elements connecting the outer casing to the sides of the opening. One such construction has inner casings of U-shaped sections of channel steel. The outer casing may be sections of steel plate of a width to fit within the opening of the U-shaped channel and of the same length. This embodiment is preferred where the barrier would only be used infrequently. It is preferred, for embodiments having more regular use, that the outer casing is also a U-shaped channel. The space between the inner and outer casings is enclosed and protected when they are connected. The outer casing may be screwed to the sides of a window opening, for example, and the inner casing and the rest of the sides of the unit inserted into the channels of the outer casing and locked in place. Then the screws connecting the outer casing are enclosed and protected and cannot be removed by an intruder. The owner may, however, easily remove the barred unit by unlocking it from the outer casing.

The locking mechanism of this invention is adapted to allow the lock to work effectively although the outer casing is at an angle to the inner casing, for example, where the side walls of the opening to be barred are not perpendicular to the plane of the opening. In this specification the expression "plane of the opening" means a plane lying across the opening parallel to a plane that a door or window might occupy in that opening.

Prior art guard devices do not allow easy attachment about an opening which is not square, that is, where the sides are not perpendicular to the plane of the opening. Installation of prior art devices in such an opening may require modification of the side walls of the opening to obtain a square surface for installation. The present invention permits the base members to be installed on an angle to the plane of the opening while the barred unit may be installed parallel to the plane of the opening with the frame members connected at an angle to the base members.

A locking device which permits rotation of the base members with respect to the frame members is depicted and described in detail in the description of the preferred embodiment of this invention. In principle the locking mechanism of this invention comprises one or more latches or the like that rotate with one or more lock cylinders in the inner casing, on the one hand, and, on the other hand, one or more fixed catches attached to the outer casing which catch and hold the bars when the lock cylinders are turned to the locked position. Each such locking mechanism has a curved lug on the latch or on the catch or both to permit engagement of the latch and catch when the outer casing is at any one of a limited predetermined number of angled positions with respect to the inner casing. Thus the locking mechanism may close and open while the outer casing and the inner casing are tilted or angled with respect to one another along a longitudinal axis and the outer casing may be wiggled or pivoted about the inner casing when locked together prior to installation. After installation rotation is not possible because the angle of the outer casing is fixed.

The amount of curvature required to enable the latch to engage the catch at all such positions will depend on the range of pivoting that is desired for any particular construction. The range of pivoting which is possible will again depend upon the particular configurations chosen for the inner casing and the outer casing. In the case of two U-shaped channel members pivoting one within the other it will be necessary to bend one or more of the side flanges of one or more of the channel members to allow pivoting to occur. In that case the degree to which such bending is practical while maintaining security will determine the angle of pivoting which is possible and the degree of curvature for the latch and catch mechanism. In other shapes of the inner and outer casings different considerations and constraints will apply. It will be appreciated by those skilled in the art what considerations and constraints will apply to such various configurations which employ the principle of this invention.

Another feature of this invention is that it allows for simple, inexpensive fabrication. In particular the tubes may be crimped on either side of the first and second strapping plates to secure them where this is required. The crimping of the tubes is less costly than welding, for example, and provides adequate strength to prevent removal of the tubes.

Crimping of the tubing is done by a tapered three split mandrel and a tapered pin which are inserted into the tubing on either side of the strapping plate. The tapered pin is driven into the mandrel to expand it and the steel tubing to a size greater than the hole in the strapping plate. The same method may be used to secure the tubes to the inner casing.

The rods may also be cold worked by a die acting on their surface to secure their first ends to the inner casing in a similar manner. The particular construction of the present invention permits it to be fabricated in this manner at low cost while providing adequate strength and greater versatility than prior art devices.

In the figures which illustrate the preferred embodiment of this invention:

FIG. 1 depicts the general assembly of the preferred embodiment.

FIG. 2 presents a detail of one end with the outer casing with the latch in the released position and, in dotted lines, in the locked position.

In the Figures like numerals indicate like elements.

Figure 1:
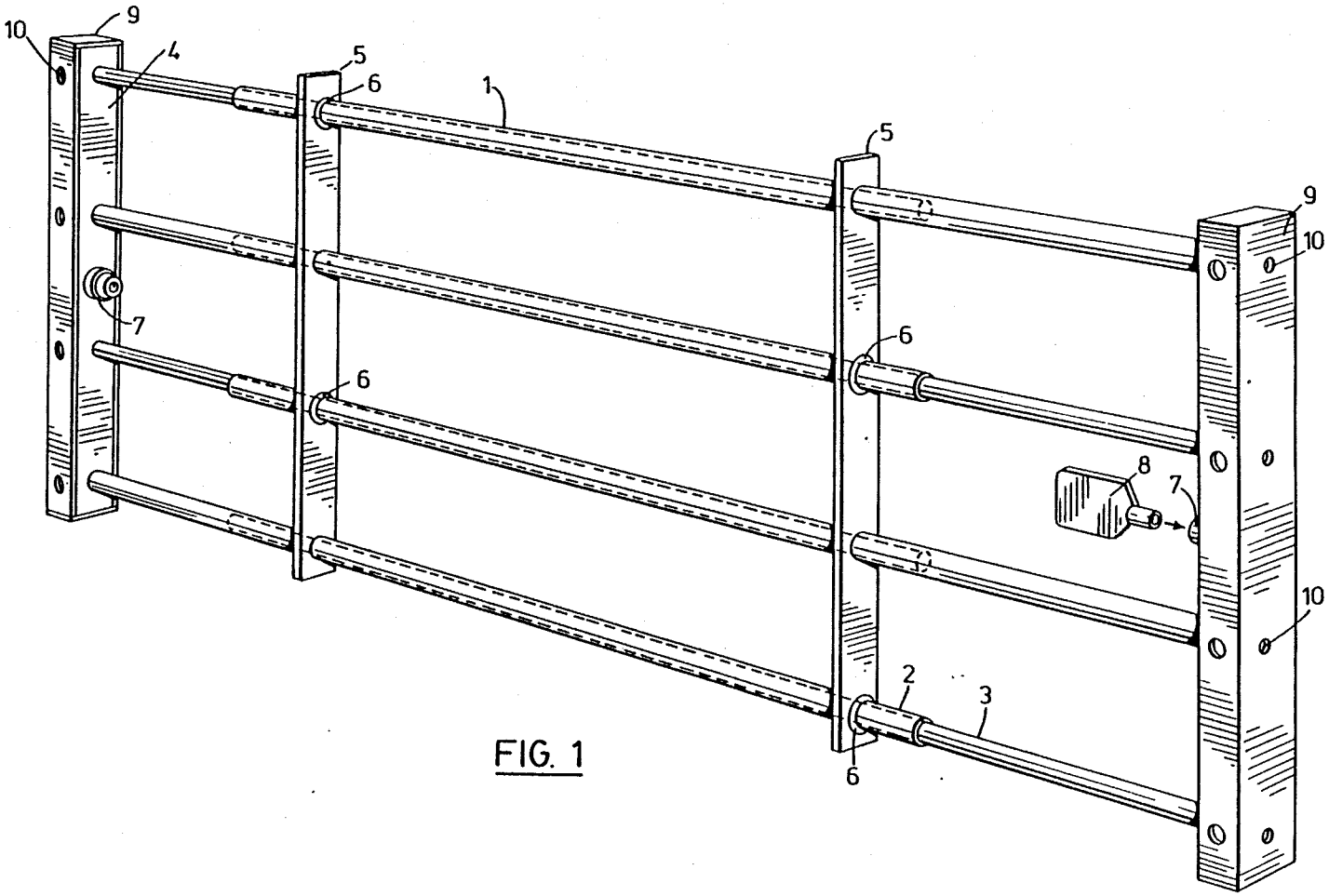

As illustrated in FIG. 1 the preferred embodiment of this invention comprises a number of bars (1), each of which is made up of a tube (2) and a rod (3) lying between inner casings (4). Each rod (3) is adapted to project into each corresponding tube (2), one end of each rod (3) is affixed to one of the two inner casings (4), similarly one end of each tube (2) is attached to one of each inner casings (4) and projects through each of the strapping plates (5). In the preferred embodiment along each inner casing (4) rods and tubes are alternately connected in series. It will appreciated that all the tubes could be connected to one inner casing while all the rods could be connected to the other inner casing.

Each tube (2) proceeding from the inner casing (4) to which it is attached next protrudes through a first strapping plate (5) and then protrudes through a second strapping plate (5). On either side of the second strapping plate (5) the tubes (2) are crimped to present a raised surface (6) which prevents the tube (2) from sliding in either direction with respect to the second strapping plate (5). Each tube (2) is however free to slide through the first strapping plate (5).

Cylinder locks (7) are shown in inner casing (4), a key (8) is used to unlock or lock the lock (7). An outer casing (9) is adapted with holes (10) to permit it to be screwed into the framework of a window or doorway.

Figure 2:
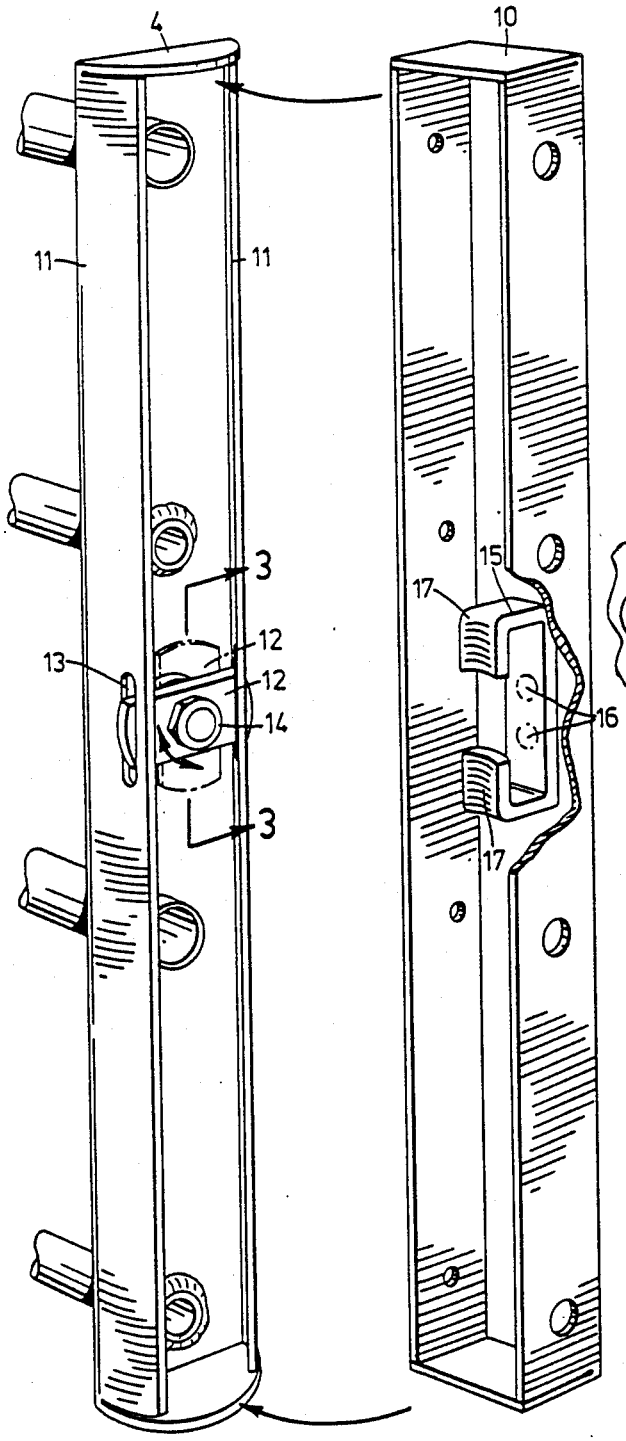

In FIG. 2 the outer casing (10) is shown removed from the inner casing (4). As illustrated the inner casing (4) has side flanges (11) which are bent inwardly to permit rotation within the outer casing (10). Inside the inner casing (4) a latch (12) is shown in dotted lines in a locked position and in complete lines in the released position. A slot (13) is provided in each flange (11) to permit the latch (12) to make a complete rotation. The latch (12) is attached to the cylindrical lock mechanism (7) by means of a shaft and bolt (14) which allows the latch to be turned with the cylindrical portion of the locks (7).

In the outer casing (10) there is fixed a catch means (15) which comprises a bar of steel bent in a C-shape and attached to the outer casing (10) by means of spot welds (16). The upwardly and downwardly projecting lugs (17) of the C-shaped catch means (15) have curved surfaces to permit the latch means (12) to engage with the catch means (15) although the outer casing (10) is tilted with respect to the inner casing (4).

Figure 3:
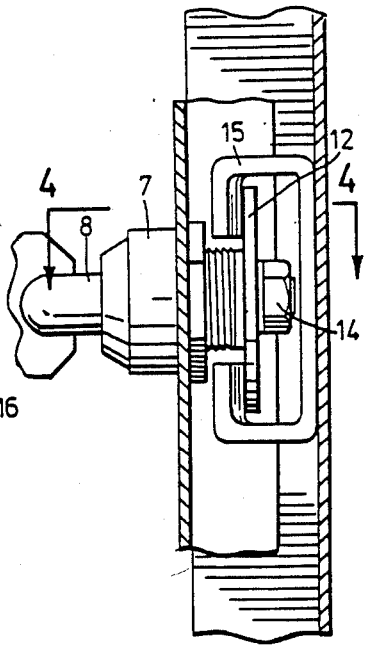
FIG. 3 is a section on 3—3 of FIG. 2 to indicate the relationship of the latch and the catch mechanism when they are locked together.

In FIG. 3 the latch (12) is shown locked in the catch means (15) thereby securing the inner casing (4) to the outer casing (10).

Figure 4:
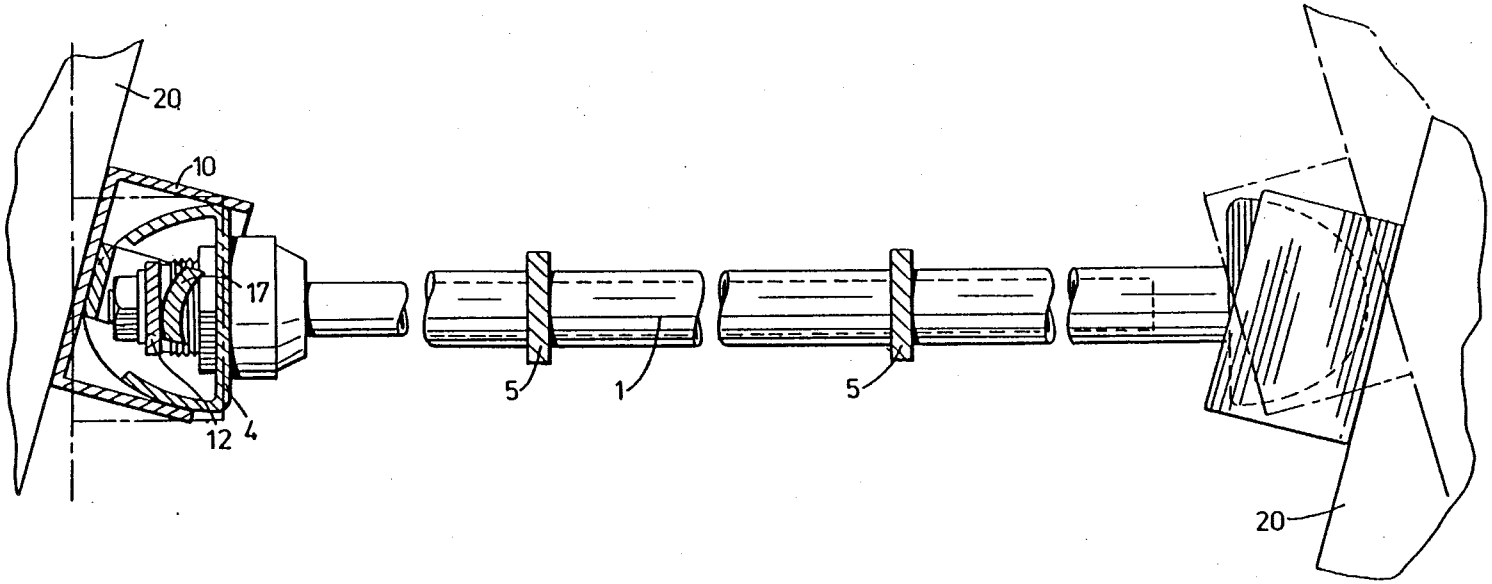
FIG. 4 is a section on 4—4 of FIG. 3 and additionally includes the rest of the assembly to demonstrate the tilting feature of the outer casing.

In FIG. 4 where the barrier of this invention is shown attached to the side walls (20) of an opening where the side walls (20) are not perpendicular to the plane of the opening. As illustrated the latch (12) engages with the lugs of lug (17) of catch (15) although the outer casing (10) is tilted with respect to the inner casing (4). As indicated by the dotted lines the side walls (20) of the opening may tilt in either direction through the limited degree of rotation without impairing the ability of this invention to be installed therein.

It will be appreciated by persons skilled in the art that modifications and changes may be made to the particulars of the configuration and construction of this invention without departing from the principle of thereof.

The embodiments in which an exclusive property and privilege is claimed are as follows:

1. A guard device to bar an opening against intruders comprising in combination;

parallel bars including a plurality of first and second rods and an equal plurality of first and second tubes, each said first rod being adapted to fit slideably within a corresponding first tube and each said second rod being adapted to fit slideably within a corresponding second tube, each said first rod and each said second tube having a first end being affixed in a spaced apart relationship longitudinally along a first inner casing, each said second rod and each said first tube having a first end affixed in a spaced apart relationship longitudinally along a second inner casing, each said first tube having a second end being adapted to protrude slideably through a first strapping plate and to protrude through and be affixed to a second strapping plate, each said second tube having a second end being adapted to protrude slideably through said second strapping plate and to protrude through and be affixed to said first strapping plate, first and second outer casings each being adapted to be attached to an opposing side of said opening by fastening means, said first outer casing being adapted to be connected to said first inner casing to permit limited rotation of said outer casing about a longitudinal axis, said second outer casing being adapted to be connected to said second inner casing to permit limited rotation of said second outer casing about a longitudinal axis, wherein said guard device may be connected across said opening to bar entrance to intruders.

2. The guard device of claim 1 in which each said outer casing is removeably connected to each said inner casing.

3. The guard device of claim 2 in which a locking mechanism is used to removeably connect each said outer casing to each said inner casing.

4. The guard device of claim 3 in which the locking mechanism comprises;

at least one lock cylinder in at least one inner casing member having a latch means connected to said lock cylinder, said latch means being positioned between said inner casing and said outer casing and being adapted to rotate with said lock cylinder between locked and unlocked positions, at least one catch means affixed to said outer casing between said outer casing and said inner casing being adapted to engage and hold said latch means whenever the latch means is rotated to the locked position and to disengage therefrom when said latch means is rotated to the unlocked position.

5. The guard device of claim 4 in which the latch means is curved to permit the latch and catch means to engage and disengage from any angle of position of said outer casing with respect to said inner casing within a predetermined range of angles of rotation about a longitudinal axis of said outer casing.

6. The guard device of claim 3 in which the catch means is curved to permit the latch and catch means to engage and disengage from any angle of position of said outer casing with respect to said inner casing within a predetermined range of angles of rotation about a longitudinal axis of said outer casing.

* * * * *